US010132447B2

(12) United States Patent
Whiteman et al.

(10) Patent No.: US 10,132,447 B2
(45) Date of Patent: Nov. 20, 2018

(54) SYSTEM AND METHOD FOR REFUELING A COMPRESSED GAS PRESSURE VESSEL USING A THERMALLY COUPLED NOZZLE

(71) Applicant: Mosaic Technology Development Pty Ltd., Brisbane, Queensland (AU)

(72) Inventors: Paul Anthony Whiteman, Brisbane (AU); Derek Shane Fekete, Brisbane (AU)

(73) Assignee: MOSAIC TECHNOLOGY DEVELOPMENT PTY LTD (AU)

( * ) Notice: Subject to any disclaimer, the term of this patent is extended or adjusted under 35 U.S.C. 154(b) by 174 days.

(21) Appl. No.: 14/654,696

(22) PCT Filed: Dec. 20, 2013

(86) PCT No.: PCT/AU2013/001512

§ 371 (c)(1),
(2) Date: Jun. 22, 2015

(87) PCT Pub. No.: WO2014/094070

PCT Pub. Date: Jun. 26, 2014

(65) Prior Publication Data

US 2015/0345706 A1 Dec. 3, 2015

(30) Foreign Application Priority Data

Dec. 20, 2012 (AU) ..... 2012905659

(51) Int. Cl.
*F17C 5/06* (2006.01)
*F17C 5/00* (2006.01)

(52) U.S. Cl.
CPC ..... *F17C 5/06* (2013.01); *F17C 5/007* (2013.01); *F17C 2201/0109* (2013.01);
(Continued)

(58) Field of Classification Search
CPC .... F17C 5/06; F17C 5/007; F17C 2270/0139; F17C 2270/0171; F17C 2270/0176;
(Continued)

(56) References Cited

U.S. PATENT DOCUMENTS 3,307,370 A * 3/1967 Klipping ..... F17C 13/028 62/210
5,813,429 A * 9/1998 Ohtaka ..... F17C 5/06 137/266

(Continued)

FOREIGN PATENT DOCUMENTS

DE 10031155 1/2002
FR 2935774 3/2010

(Continued)

OTHER PUBLICATIONS

International Search Report to corresponding Int'l Pat. Appl. No. PCT/AU2013/001512, dated Feb. 17, 2014, 5 pages.

*Primary Examiner* — Timothy L Maust
(74) *Attorney, Agent, or Firm* — Tarolli, Sundheim, Covell & Tummino LLP

(57) ABSTRACT

A pressure vessel refueling system enables consistent mass flow rates and reduces the in-tank temperature rise caused by the heat of compression as gas is added to a vessel. The system includes a pressure vessel having a first gas inlet/outlet port and an interior cavity, and a nozzle is in fluid communication with the first gas inlet/outlet port. The nozzle and the pressure vessel are thermally coupled such that Joule-Thomson expansion of a gas flowing through the nozzle cools the interior cavity and contents of the pressure vessel.

13 Claims, 3 Drawing Sheets

(52) U.S. Cl.
CPC .. *F17C 2201/032* (2013.01); *F17C 2201/054* (2013.01); *F17C 2205/035* (2013.01); *F17C 2205/0341* (2013.01); *F17C 2205/0367* (2013.01); *F17C 2205/0391* (2013.01); *F17C 2221/033* (2013.01); *F17C 2223/0123* (2013.01); *F17C 2223/033* (2013.01); *F17C 2225/0123* (2013.01); *F17C 2225/036* (2013.01); *F17C 2225/043* (2013.01); *F17C 2227/0192* (2013.01); *F17C 2227/036* (2013.01); *F17C 2227/0337* (2013.01); *F17C 2227/0372* (2013.01); *F17C 2227/0388* (2013.01); *F17C 2250/01* (2013.01); *F17C 2260/023* (2013.01); *F17C 2265/065* (2013.01); *F17C 2270/0139* (2013.01); *F17C 2270/0171* (2013.01); *F17C 2270/0176* (2013.01); *F17C 2270/0178* (2013.01)

(58) Field of Classification Search
CPC ..... F17C 2270/0178; F17C 2265/065; F17C 2260/023; F17C 2250/01; F17C 2227/0192; F17C 2227/0037; F17C 2227/036; F17C 2227/0372; F17C 2227/0388; F17C 2225/0123; F17C 2225/036; F17C 2225/043; F17C 2223/0123; F17C 2223/033; F17C 2221/033; F17C 2205/0341; F17C 2205/035; F17C 2205/0367; F17C 2205/0391; F17C 2201/0109; F17C 2201/032; F17C 2201/054
See application file for complete search history.

(56) References Cited

U.S. PATENT DOCUMENTS

| | | | | |
|---|---|---|---|---|
| 5,820,102 | A | 10/1998 | Borland | |
| 7,617,848 | B2 | 11/2009 | Matheoud et al. | |
| 7,735,528 | B2 | 6/2010 | Handa | |
| 2007/0012071 | A1* | 1/2007 | Huang ..... | F25J 1/0265 62/612 |

FOREIGN PATENT DOCUMENTS

| | | |
|---|---|---|
| WO | 2008074075 | 6/2008 |
| WO | 2012122599 | 9/2012 |

* cited by examiner

SYSTEM AND METHOD FOR REFUELING A COMPRESSED GAS PRESSURE VESSEL USING A THERMALLY COUPLED NOZZLE

FIELD OF THE INVENTION

This invention relates generally to a compressed gas transfer system. In particular, the invention relates to a compressed natural gas (CNG) transfer system including a nozzle thermally coupled to and optionally inside a CNG cylinder to reduce temperature rises in the cylinder.

BACKGROUND OF THE INVENTION

Natural gas fuels are relatively environmentally friendly for use in vehicles, and hence there is support by environmental groups and governments for the use of natural gas fuels in vehicle applications. Natural gas based fuels are commonly found in three forms: Compressed Natural Gas (CNG), Liquefied Natural Gas (LNG) and a derivative of natural gas called Liquefied Petroleum Gas (LPG).

Natural gas fuelled vehicles have impressive environmental credentials as they generally emit very low levels of $SO_2$ (sulphur dioxide), soot and other particulate matter. Compared to gasoline and diesel powered vehicles, $CO_2$ (carbon dioxide) emissions of natural gas fuelled vehicles are often low due to a more favourable carbon-hydrogen ratio found in natural gas. Natural gas vehicles come in a variety of forms, from small cars to buses and increasingly to trucks in a variety of sizes. Natural gas fuels also provide engines with a longer service life and lower maintenance costs. Further, CNG is the least expensive alternative fuel when comparing equal amounts of fuel energy. Still further, natural gas fuels can be combined with other fuels, such as diesel, to provide similar benefits mentioned above.

A key factor limiting the use of natural gas in vehicles is the storage of the natural gas fuel. In the case of CNG and LNG, the fuel tanks are generally expensive, large and cumbersome relative to tanks required for conventional liquid fuels having equivalent energy content. In addition, the relative lack of wide availability of CNG and LNG refuelling facilities, and the cost of LNG, add further limitations on the use of natural gas as a motor vehicle fuel. Further, in the case of LNG, the cost and complexity of producing LNG and issues associated with storing a cryogenic liquid on a vehicle further limit the widespread adoption of this fuel.

While LNG has had some success as a liquid fuel replacement in some regions of the world, the lack of availability of LNG and its high cost means that in many regions of the world it is not a feasible alternative fuel. In the case of CNG, it also has had some success as a liquid fuel replacement but almost exclusively in spark ignition engines utilising low pressure carburetted port injection induction technology. This application is popular in government bus fleets around the world where the cleaner burning natural fuel is used in a spark ignition engine fitted in place of a conventional diesel engine.

Some of the above issues are also mitigated when using LPG, and this fuel is widely used in high mileage motor cars such as taxis. However, cost versus benefit comparisons are often not favourable in the case of private motor cars. Issues associated with the size and shape of the fuel tank, the cost variability of LPG and the sometimes limited supply mean that LPG also has significant disadvantages that limit its widespread adoption. In summary, unless there is massive investment in a network of LNG plants around major transport hubs, CNG is the only feasible form of natural gas that is likely to be widely utilised in the near future.

However, some technical problems still limit the efficiency of CNG fuel systems. For example, the pressure to which composite CNG cylinders can be filled at a typical CNG re-fuelling station is limited because the heat of compression can cause overheating of cylinders being filled. This has typically meant that a nominal 250 bar at 21 degrees Celsius (settled temperature) is the limit for composite CNG cylinder design, and has become the standard adopted in many parts of the world including the US.

In the US, codes typically allow for filling to an overpressure of 1.25 times the pressure rating of the CNG cylinder provided it would subsequently settle to a nominal 250 bar if cooled to 21 deg. C. The code also identifies in-cylinder heating as having the potential to cause transient temperature excursions exceeding cylinder design parameters, and these high temperatures also cause higher internal cylinder pressures such that fills of between 70% and 80% of cylinder "name plate" ratings are often all that can be achieved. This has a significant detrimental impact on the range of CNG vehicles, and also on consumers who often have difficulty understanding the variability of a CNG cylinder fill and the impacts on vehicle range.

Also, the variability and inability to fully fill CNG cylinders has a major impact on the use of CNG cylinders in bulk gas transport, where poor CNG cylinder filling has significant commercial impact on the cost of gas delivered.

For example, in Europe, the relevant codes limit the maximum pressure in composite CNG cylinders during re-fuelling to 260 barg to ensure maximum design temperatures are not exceeded. These limitations meant that the currently available composite cylinders designed for 350 barg operating pressure and above could not be utilised in conventional CNG re-fuelling systems. Thus the opportunity to utilise smaller CNG cylinders, or to achieve increases in vehicle range, or improved commercial outcomes for gas transport, using the same size fuel cylinders, can not be realised.

A further problem with current systems for fast refuelling of large CNG vessels, such as used in buses and trucks, is that the size and weight of the refuelling connection makes them difficult to handle and problematic relative to the smaller connectors used commonly for filling cars.

International Patent Application Publication, WO 2008/074075, titled "A COMPRESSED GAS TRANSFER SYSTEM", disclosed for the first time a liquid backpressure system that enables the complete filling of on-vehicle CNG fuel tanks at full pressures. However, with this system the delivery of liquid into and out of CNG cylinders limits the application of the technology, and can slow transfer rates due to limitations in the liquid handling.

There is therefore a need for an improved system and method for refuelling compressed gas pressure vessels.

OBJECT OF THE INVENTION

It is an object of some embodiments of the present invention to provide consumers with improvements and advantages over the above described prior art, and/or overcome and alleviate one or, more of the above described disadvantages of the prior art, and/or provide a useful commercial choice.

SUMMARY OF THE INVENTION

In one form, although not necessarily the only or broadest form, the invention resides in a pressure vessel refuelling system comprising:

a pressure vessel having a first gas inlet/outlet port and an interior cavity; and a nozzle in fluid communication with the first gas inlet/outlet port;

wherein the nozzle and the pressure vessel are thermally coupled such that Joule-Thomson expansion of a gas flowing through the nozzle cools the interior cavity and contents of the pressure vessel.

Preferably, the nozzle is a convergent-divergent (CD) nozzle.

Preferably, the nozzle is positioned in the interior cavity of the pressure vessel.

Preferably, the nozzle is positioned in the interior cavity of the pressure vessel and spaced away from the first gas inlet/outlet port.

Preferably, the nozzle is positioned outside the interior cavity of the pressure vessel and adjacent the first gas inlet/outlet port.

Preferably, the pressure vessel is a compressed natural gas (CNG) vessel.

Preferably, the inlet pressure to the nozzle is maintained at a continuous high pressure to increase Joule-Thomson cooling.

Preferably, the nozzle maintains a relatively continuous high flow throughout a vessel refilling cycle Preferably, the pressure vessel is one of a plurality of pressure vessels used for the storage or transport of compressed natural gas (CNG).

Preferably, the pressure vessel further comprises a secondary gas outlet port in fluid communication with a gas delivery line in fluid communication with the first gas inlet/outlet port, whereby a portion of gas in the refuelling system traverses a cooling cycle loop, cooling the interior cavity and contents of the pressure vessel.

Preferably, the cooling cycle loop includes a gas chiller.

Preferably, the cooling cycle loop includes a secondary gas compressor.

Preferably, the cooling cycle loop includes a flow control valve in fluid communication with the secondary gas outlet port, whereby a gas recycle rate through the pressure vessel is controlled.

Preferably, the cooling cycle loop includes a recirculation compressor in fluid communication with the secondary gas outlet port, whereby a gas recycle rate through the pressure vessel is controlled.

BRIEF DESCRIPTION OF THE DRAWINGS

To assist in understanding the invention and to enable a person skilled in the art to put the invention into practical effect, preferred embodiments of the invention are described below by way of example only with reference to the accompanying drawings, in which.

Figure 1:
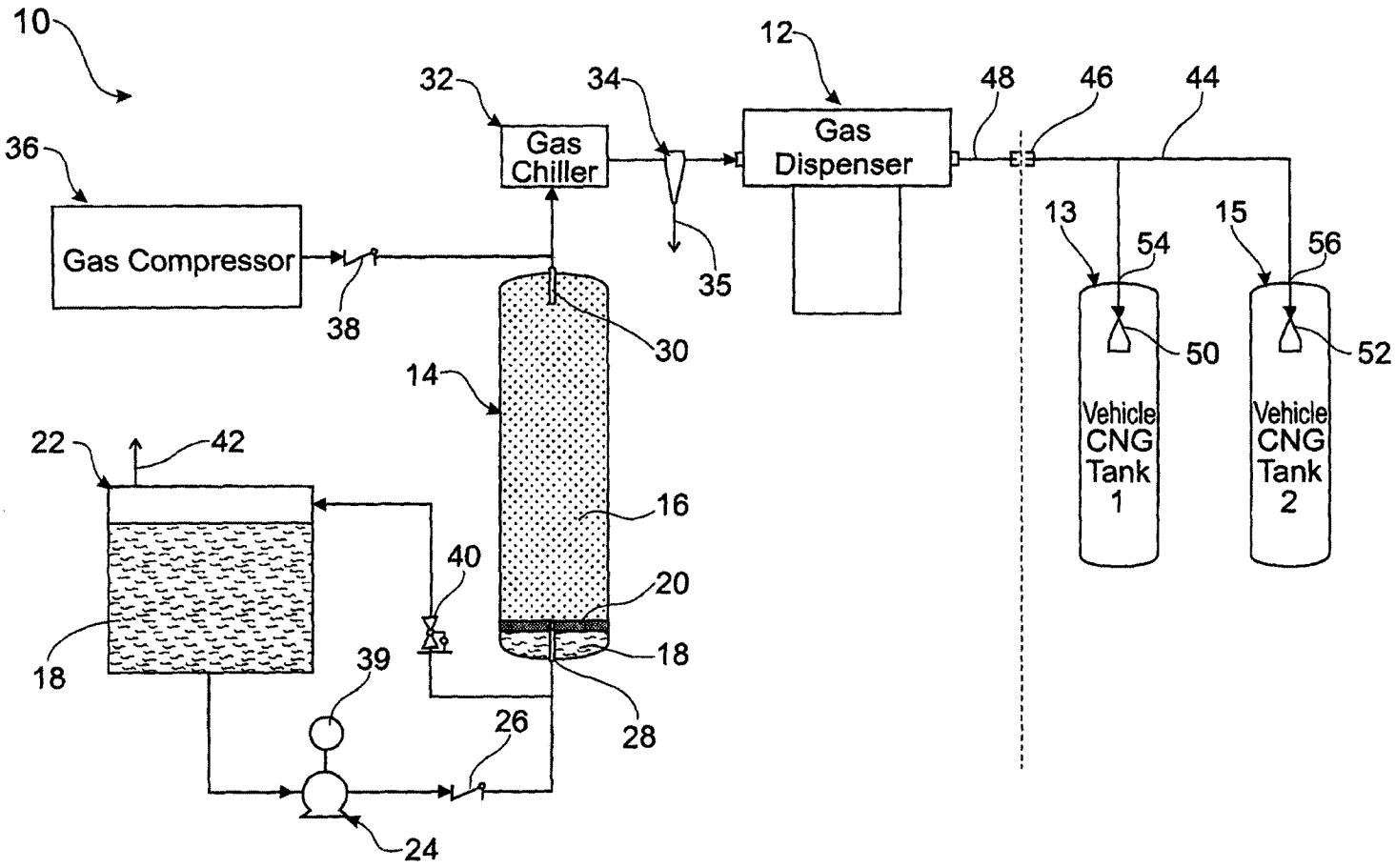
FIG. 1 illustrates a pressure vessel refuelling system that supplies gas at high pressure to a gas dispenser, which then supplies the gas to CNG fuel tanks, according to an embodiment of the present invention.

Those skilled in the art will appreciate that minor deviations from the layout of components as illustrated in the drawings will not detract from the proper functioning of the disclosed embodiments of the present invention.

DETAILED DESCRIPTION OF THE PREFERRED EMBODIMENT

Embodiments of the present invention comprise systems and methods for refuelling compressed gas pressure vessels using a thermally coupled nozzle. Elements of the invention are illustrated in concise outline form in the drawings, showing only those specific details that are necessary to the understanding of the embodiments of the present invention, but so as not to clutter the disclosure with excessive detail that will be obvious to those of ordinary skill in the art in light of the present description.

In this patent specification, adjectives such as first and second, left and right, front and back, top and bottom, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention.

According to one aspect, the invention includes a pressure vessel refuelling system. The system includes a pressure vessel having a first gas inlet/outlet port and an interior cavity. A nozzle is in fluid communication with the first gas inlet/outlet port. The nozzle and the pressure vessel are thermally coupled such that Joule-Thomson expansion of a gas flowing through the nozzle cools the interior cavity of the pressure vessel.

Advantages of the present invention include enabling improved fast fill refuelling of CNG fuel tanks by reducing the in-tank temperature rise caused by the heat of compression as gas is added to a tank. Further, the use of a nozzle inside or adjacent a fuel tank enables faster mass flow rates of gas into the tank during refuelling. Also, according to some embodiments, by re-cycling a portion of gas out of a tank during refuelling and back to a gas chiller, further cooling of a tank is achieved. That enables a tank to be quickly filled to its capacity pressure rating at a non-elevated operating temperature such as 21 degrees C., eliminating the "partial fill" result of prior art processes for refuelling CNG tanks caused by the heat of compression significantly raising tank temperatures. Further, by connecting high pressure supply lines from a supply source directly to an interior of a tank being refuelled, smaller diameter supply lines can be employed, enabling reduced-size CNG couplings. Also, frictional energy losses in the supply hoses are reduced, because gas in a high pressure line will travel at a slower velocity to achieve an equivalent mass flow rate of corresponding low pressure line. Further this leads to the potential to fast fill vehicles with large CNG vessels, such as buses and trucks, using the standard consumer friendly nozzles used for CNG car refuelling. Further holding the gas at consistent pressure up to the vessel, through the chilling system, enables chilling of the gas with an economic heat exchanger. The density of the gas remains high and the velocity consistent and optimal through the heat exchanger, thus facilitating good heat exchange performance per unit surface area.

In this specification CNG cylinders that supply or store gaseous fuel are synonymously referred to as tanks, vessels, pressure vessels, CNG cylinders and cylinders.

FIG. 1 illustrates a pressure vessel refuelling system 10 that supplies gas at high pressure to a gas dispenser 12, which then supplies the gas to CNG fuel tanks 13, 15, according to an embodiment of the present invention. The system 10 includes a CNG primary storage vessel 14 that is partially filled with natural gas 16 and partially filled with an aqueous liquid 18. A thin layer of a second liquid in the form of an oil 20 floats on top of the aqueous liquid 18. Because the oil 20 is both immiscible with the aqueous liquid 18 and is less dense than the aqueous liquid 18, the layer of oil 20 functions as a "liquid piston" that moves up and down inside the vessel 14 as a volume of the aqueous liquid 18 in the vessel 14 changes.

The floating layer of oil 20 creates a barrier that prevents the aqueous liquid 18 from contacting and evaporating into the natural gas 16. In some cases the oil 20 may become saturated with the natural gas 16. However, because the oil 20 does not leave the storage vessel 14, and because only a thin layer of oil 20 is required (which becomes saturated with natural gas on initial fill), only insignificant natural gas 16 is not available, or is lost from storage.

The system 10 further includes a liquid storage tank 22 and a pump 24. In use, for example when a CNG vehicle or a plurality of CNG vehicles are being refuelled from the gas dispenser 12, the pump 24 pumps the aqueous liquid 18 through a check valve 26 and through a lower float valve 28 in a lower inlet/outlet port and into the vessel 14. Simultaneously, the natural gas 16 flows through an upper float valve 30 in an upper inlet/outlet port, through a gas chiller 32 and to the dispenser 12.

The lower float valve 28 functions to prevent the gas 16 from exiting through the bottom of the vessel 14 in the event that all of the aqueous liquid 18 is drained from the vessel 14. Similarly, the upper float valve 30 functions to prevent the aqueous liquid 18 from exiting through the top of the vessel 14 in the event that all of the gas 16 is pushed out of the vessel 14 by the layer of oil 20 rising to the top of the vessel 14. As an example, the lower float valve 28 and the upper float valve 30 can function as described in international patent application no. PCT/AU2012/000265, titled Compressed Natural Gas Tank Float Valve System and Method published on 20 Sep. 2012 under International Publication No. WO2012/122599, the contents of which are hereby incorporated in their entirety.

During the refuelling process, for example of a vehicle fuel tank connected to the dispenser 12, a coalescer filter 34 functions as a filter to remove traces of the oil 20 from the gas 16 before such traces reach the dispenser 12. It is normal in the CNG industry to use such filtration methods to remove trace compressor oil. However, unlike in a compressor, the oil-gas interface is essentially static and does not entrain oil in the gas. Thus the layer of oil 20 enables a significantly more efficient gas transfer system, even though traces of the oil 20 may require filtering by the coalescer filter 34. It is noted as industry normal for a small amount of compressor oil to carry over with the compressed gas. Thus managing oil carry over from the storage is seen as little different to managing conventional oil carry over with gas from the gas compressors.

When re-filling the CNG storage vessel 14 with natural gas 16, or while re-fuelling a vehicle using the dispenser 12, a gas compressor 36 can be activated to allow the gas 16 to be compressed and supplied via a check valve 38 from a natural gas supply line (not shown) either into the storage vessel 14 or directly to the dispenser 12.

A pressure controller 39 enables the pump 24 to be activated automatically when a pressure drop is detected in the storage vessel 14. Working simultaneously with the gas compressor 36, the pump 24 enables a high flow rate of gas to be delivered to the dispenser 12; that in turn enables, for example, multiple CNG fuel tanks/vehicles to be refuelled simultaneously from the dispenser 12 or a plurality of dispensers.

By displacing the already compressed natural gas 16 from storage 14 at constant high pressure to the dispenser 12, the steady state power needed by the system 10 to maintain a constant maximum output of gas 16 from the dispenser 12 can be reduced by up to an order of magnitude when compared to using online CNG compression to meet the required delivery rate, from conventional industrial natural gas supply pressures. That means, for example, when refuelling several CNG vehicles simultaneously from the dispenser 12, the compressor 36 can be much smaller than would be required in a comparable refuelling system that did not maintain or use a CNG storage vessel at a constant pressure using liquid displacement of the stored gas. According to the present invention the full amount of stored gas is available and deliverable at several times the rate that would otherwise be possible using the equivalent power applied only to a gas compressor.

The constant pressure from the supply system maximises the Joule-Thomson cooling effect available at the cylinder nozzles 50, 52.

During refilling of the vessel 14 with the gas 16, as the gas 16 is compressed into the vessel 14, the layer of oil 20 applies pressure to the aqueous liquid 18 and opens a back pressure valve 40. The aqueous liquid 18 then flows through the back pressure valve 40 and back into the liquid storage tank 22. As the liquid level rises in the storage tank 22, air in the tank 22 is vented to atmosphere through a vapour vent 42.

During a refuelling process, CNG gas exits the dispenser 12 while still at a storage pressure such as 6000 psig and is directed into the CNG fuel tanks 13, 15 via high pressure lines 44. Those skilled in the art will appreciate that various standard connectors, bleed valves, etc. are ordinarily included at an interface 46 between an output line 48 of the dispenser 12 and the supply lines 44. The storage pressure is maintained until the gas flow reaches a nozzle 50, 52 inside the fuel tanks 13, 15, respectively.

When refuelling begins of an empty fuel tank 13, 15, the pressure differential between the high pressure supply lines 44 upstream of the nozzles 50, 52 and the inside cavities of the fuel tanks 13, 15 is generally greatest because the tanks 13, 15 may be nearly empty. As understood by those skilled in the art, and following basic fluid dynamics principles concerning nozzles, supersonic flow therefore will be initiated through the nozzles 50, 52, causing gas flow in the nozzles 50, 52 to be "choked". Because the supersonic flow near a throat of the nozzles 50, 52 prevents pressure waves from travelling upstream of the nozzles 50, 52, the mass flow rate through the nozzles 50, 52 is generally unaffected by changes in downstream pressure, even as the pressure in the fuel tanks 13, 15 steadily increases.

Further, Joule-Thomson expansion of the gas across the nozzles 50, 52, causes the gas entering the tanks 13, 15 to substantially cool. However, simultaneously the heat of compression of the gas already inside the fuel tanks 13, 15 tends to cause the gas temperature to increase. The result, according to embodiments of the present invention, is that an overall temperature rise of gas in the tanks 13, 15 during the refuelling process is substantially moderated compared to the prior art. Initial cooling of the gas at the gas chiller 32 further assists in decreasing the temperature rise of the gas during the refuelling process.

The nozzles 50, 52 can be of various designs, including for example conventional convergent-divergent (CD) nozzles. Alternatively, each nozzle 50, 52 can be replaced by a simple orifice. If the orifices are adequately small, pressure inside the high pressure supply lines 44 can be maintained at or near the storage pressure, such as 5000 psig, and thus most Joule-Thomson expansion and the associated Joule-Thomson cooling of the supplied gas will occur inside the fuel tanks 13, 15 and not in the high pressure supply lines 44.

The nozzles 50, 52 are positioned inside the tanks 13, 15 and away from inlet/outlet ports 54, 56 and away from the interior surfaces of the tanks 13, 15. That prevents localised intense cooling from Joule-Thomson expansion of the gas severely cooling and possibly compromising the structural integrity of sides of the tanks 13, 15. Any ice or hydrates that form on the divergent section of the nozzles 50, 52 is simply blown off the nozzles 50, 52 by the gas flow and falls/vaporises in the interior cavity of the tanks 13, 15.

According to other alternative embodiments of the present invention, the nozzles 50, 52 can be positioned outside of and adjacent to the tanks 13, 15, and thus immediately upstream of the inlet/outlet ports 54, 56. If the high pressure supply lines 44 and the nozzles 50, 52 are thermally insulated from the outside environment, the nozzles 50, 52 still can be adequately thermally coupled to the tanks 13, 15. Joule-Thomson expansion of the gas across the nozzles 50, 52 will thus still cool the interior of the tanks 50, 52 during refuelling.

Figure 2:
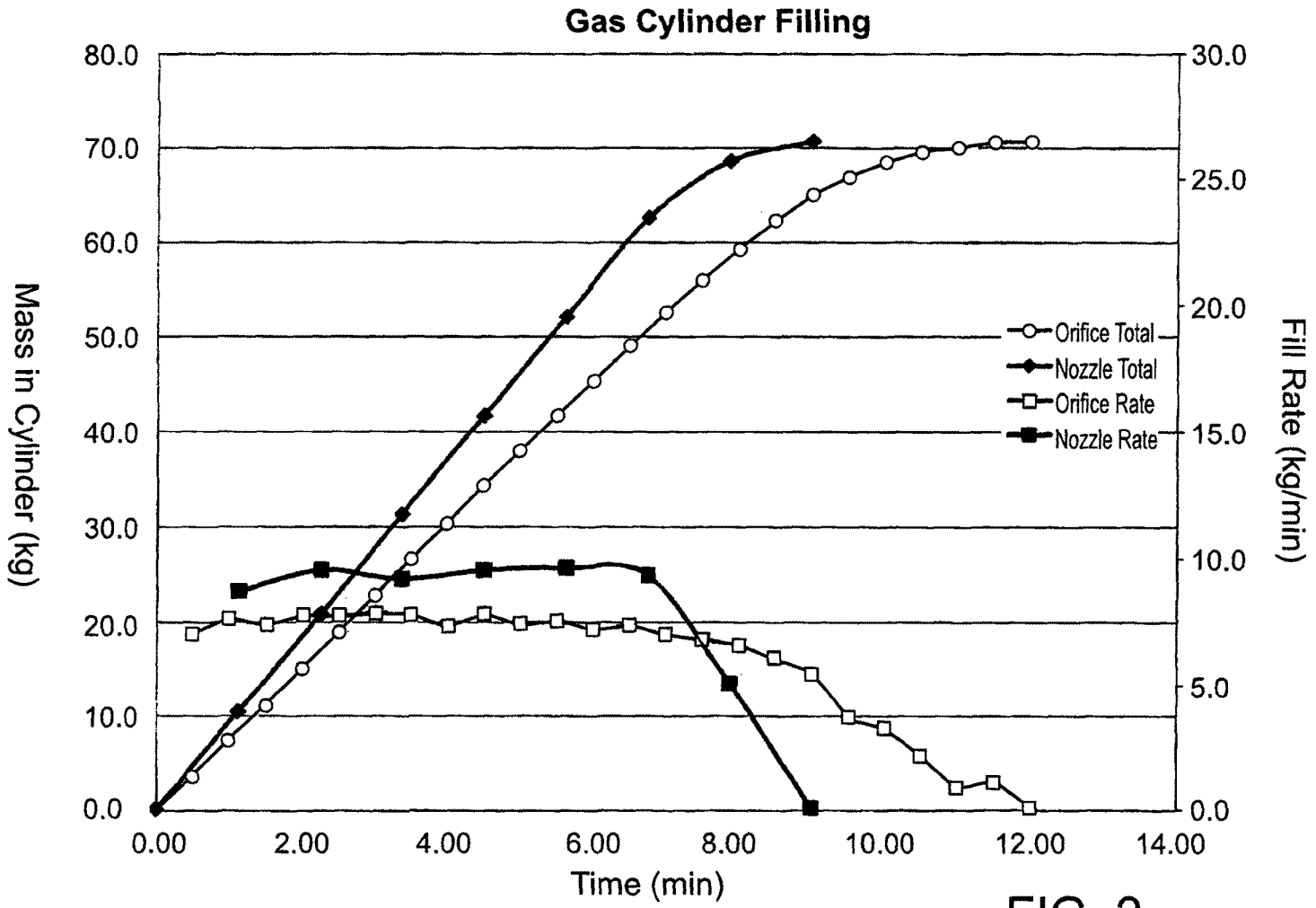
FIG. 2 is a graph illustrating an example of mass flow rate vs. time of CNG gas into a typical CNG storage vessel, such as a CNG vehicle fuel tank, according to an embodiment of the present invention.

FIG. 2 is a graph illustrating an example of mass flow rate (kg/min) vs. time (min) and the corresponding accumulated mass (kg) vs. time of CNG gas into a typical CNG storage vessel, such as a CNG fuel tank 13, 15, during a refuelling process according to an embodiment of the present invention. The line labelled "Orifice Rate" illustrates the gas mass flow rate into the vessel during a refuelling process when an orifice is positioned inside the vessel at the end of a high pressure supply hose. The line labelled "Nozzle Rate" illustrates the gas mass flow rate into the same vessel during a similar refuelling process when a CD nozzle is positioned inside the vessel at the end of a high pressure supply hose. The lines labelled "Orifice Total" and "Nozzle Total" refer to the total accumulated mass stored in the vessel during the refuelling process using, respectively, an orifice and a nozzle at the end of the gas supply hose.

The vessel used to collect the data for FIG. 2 was a 300 liter type IV (polymer-lined, composite overwrapped) pressure vessel, initial pressure in the vessel for both the orifice and the nozzle fill was approximately one atmosphere at room temperature, and a ⅜ inch supply line operating at a constant pressure of approximately 6000 psig delivered the gas to the vessel.

As shown, the orifice delivers a reasonably steady mass flow rate of about 7-8 kg/min. of gas for the first six minutes of refuelling. However, as the pressure in the tank increases, and accordingly the differential pressure across the orifice decreases, the mass flow rate also steadily decreases during the period of six minutes to 12 minutes from the start of refuelling.

However, as shown, the nozzle delivers significantly better performance. The mass flow rate at the beginning of refuelling is slightly better than with an orifice, and remains steady for about the first seven minutes of refuelling. Because the mass flow rate of a choked gas flow through a nozzle is generally unaffected by downstream pressure changes, the increasing pressure in the tank during refuelling does not slow the mass flow rate into the tank.

After about seven minutes of refuelling, the mass flow rate through the nozzle drops precipitously. That is because as the tank becomes full the tank pressure approaches the supply line pressure, and the pressure differential across the nozzle thus drops and causes gas flow through the nozzle to become sub-sonic and thus "non-choked". Using a nozzle the vessel is substantially full in seven minutes; whereas using an orifice the vessel requires about 12 minutes to fill.

As shown, a nozzle can deliver an equivalent amount of gas mass into a vessel in less time than can be delivered using a simple orifice. Thus the use of a nozzle according to the teachings of the present invention can further reduce the time required to refuel a vessel such as the CNG fuel tanks 13, 15. The nozzle used in the above example demonstrates approximately a 30% reduction in refuelling time relative to a simple orifice by elimination of the long conventional CNG top off tail. The nozzle design can be optimised to vary flow rate and steepness of drop off characteristics.

Additionally, it is noted that the constant flow rate provided by nozzles can simplify the control in transferring CNG at a high transfer rate, relative to simple orifice designs, where, for example, oversized orifices may be used and additional cylinders sequenced to maintain a high fuelling rate as the flow drops through the orifice—no sequencing is required to maintain flow rate with nozzles as the flow remains nearly constant throughout the fill by the nozzle.

Figure 3:
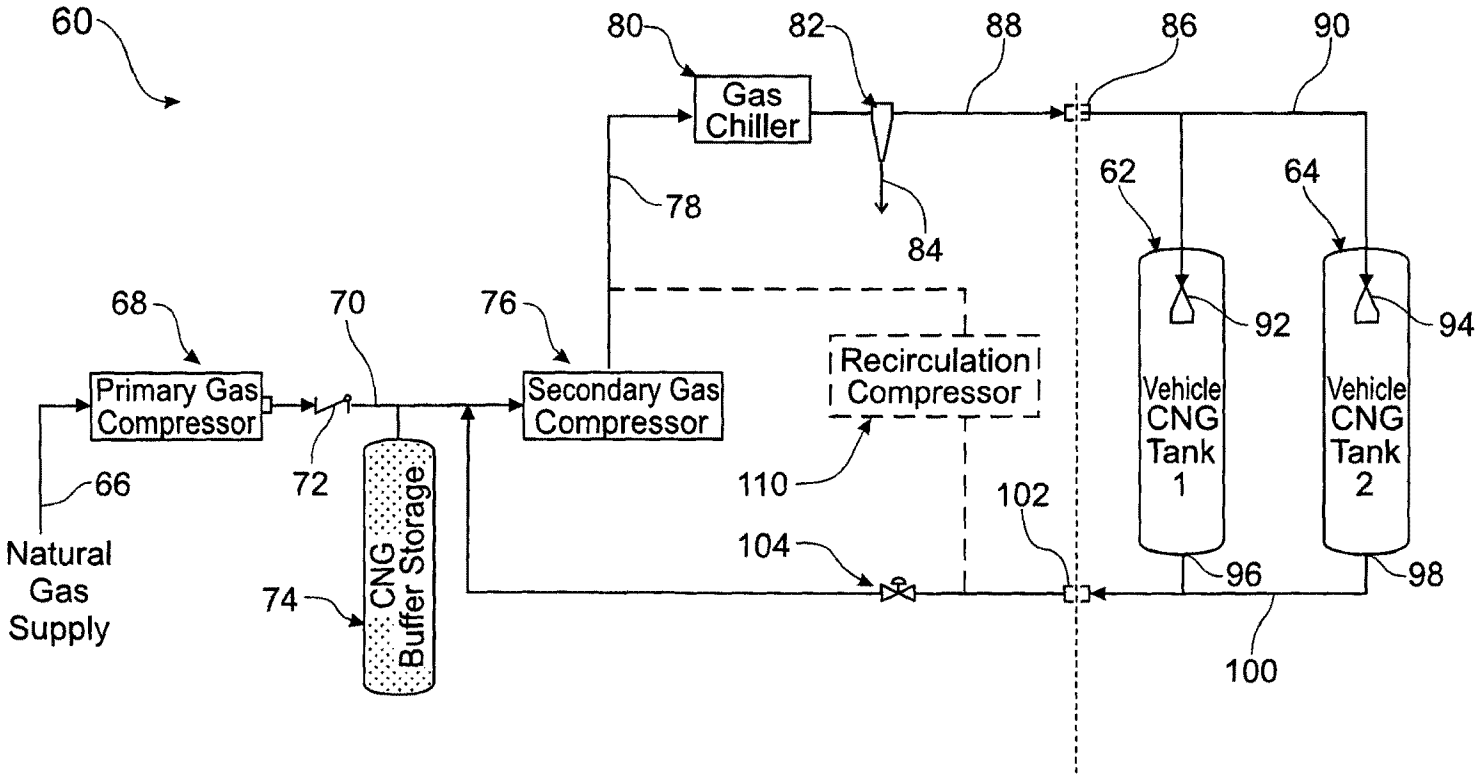
FIG. 3 illustrates a pressure vessel refuelling system, including a cooling cycle loop, which supplies gas at high pressure to CNG transport or storage cylinders according to an embodiment of the present invention.

FIG. 3 illustrates a pressure vessel refuelling system 60, including a cooling cycle loop, which supplies gas at high pressure to CNG transport tanks 62, 64, according to an embodiment of the present invention. Natural gas enters the system 60 via a supply line 66 at a pipeline supply pressure, such as 15-500 psig. The gas then enters a primary gas compressor 68 where it is compressed to a buffer storage pressure such as 3600 psig. A supply line 70 is connected to an output of the primary gas compressor 68 and includes a check valve 72. The supply line 70 supplies gas to both a CNG buffer storage vessel 74 and to a secondary gas compressor 76, which has a higher flow capacity than the primary gas compressor 68. A supply line 78 is connected to an output of the secondary gas compressor 76 and is at a final supply pressure, such as 6000 psig.

Similar to the pressure vessel refuelling system 10 described above, in the system 60 a gas chiller 80 is used to pre-cool the gas before delivery to the tanks 62, 62. Downstream of the gas chiller 80, a gas coalescer 82 is used to remove excess aerosols from the gas, which are then removed through a condensate drain 84.

As will be understood by those skilled in the art, standard connectors, bleed valves, etc. are ordinarily included at an interface 86 between supply lines 88 and supply lines 90 that connect directly to the tanks 62, 64. Similar to the tanks 13, 15 of system 10, the supply lines 90 are connected directly to nozzles 92, 94 positioned in an interior cavity of the tanks 62, 64. Joule-Thomson expansion of the gas thus occurs almost exclusively inside the tanks 62, 64, reducing overall gas temperature rises inside the tanks 62, 64 due to the heat of compression, as described above.

Further, the tanks 62, 64 include secondary outlet ports 96, 98 connected to a gas recycling line 100. An interface 102, including for example a check valve, bleed valves, etc. connects the recycle line 100 back to the supply line 70 and to an input of the secondary gas compressor 76. A flow control valve 104 enables a gas recycle rate from the tanks 62, 64 to the secondary gas compressor 76 to be controlled. By connecting the recycle line 100 to the supply line 70 that is maintained at the reduced pressure of the CNG buffer storage vessel 74, the compression energy required to circulate gas from the tanks 62, 64 and through the refrigeration loop formed by the recycle line 100 is reduced.

As illustrated by the dashed lines in FIG. 3, an alternative method of recycling by a separate recirculation compressor 110 can be used instead of the flow control valve 104 to achieve controlled rate of recirculation.

A constant pressure from the supply lines 90 increases the Joule-Thomson cooling effect available at the in-cylinder nozzles 92 and 94 and reduces the need for gas recirculation.

According to embodiments of the present invention, the gas recycling line 100 thus closes a cooling cycle loop through the tanks 62, 64. During a refuelling process, the mass flow rate of gas into the tanks 62, 64 via the supply lines 90 exceeds the mass flow rate of gas out of the tanks 62, 64 via the gas recycling line 100. The tanks 62, 64 thus are refilled with gas while simultaneously the temperature rise of the gas from the heat of compression can be significantly reduced or eliminated using the cooling cycle that extracts heat froth the system 60 through the gas chiller 80.

The embodiment illustrated in FIG. 3 is particularly useful for "virtual pipeline" applications, where banks of numerous CNG storage vessels are installed in a shipping container or other transportation configuration to enable transport of CNG gas from a main supply source to remote distribution/utilisation facilities.

In summary, advantages of the present invention include enabling fast fill refuelling of CNG fuel tanks by reducing the in-tank temperature rise caused by the heat of compression as gas is added to a tank. Further, the use of a nozzle inside or adjacent a fuel tank enables fast, consistent mass flow rates of gas into the tank during refuelling, substantially reducing fill time. Also, according to some embodiments, by re-cycling a portion of gas out of a tank during refuelling, or after initial refuelling, and back to a gas chiller, further cooling of a tank is achieved. That enables a tank to be quickly filled to its rated capacity at reduced temperature, eliminating the "partial fill" result of prior art processes for refuelling CNG tanks caused by the heat of compression significantly raising tank temperatures. Further, by maintaining high pressure supply all the way up to and into the tank being refuelled, smaller diameter hoses/lines and smaller refuelling quick connections and fittings can be employed, and frictional/flowing losses in the hoses, lines and fittings are substantially reduced.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

The invention claimed is:

1. A system for refueling a compressed gas pressure vessel comprising:

a natural gas supply line;

a gas chiller;

an interface;

wherein natural gas flows from the natural gas supply line through the gas chiller and the interface;

a pressure vessel having a first gas inlet/outlet port and an interior cavity, the first gas inlet/outlet port being in releasable fluid communication with the interface; and a convergent-divergent ("CD") nozzle positioned downstream of the gas chiller and in fluid communication with the first gas inlet/outlet port;

wherein the nozzle and the pressure vessel are thermally coupled such that Joule-Thomson expansion of natural gas flowing through the nozzle cools the interior cavity and contents of the pressure vessel, and whereby a backpressure upstream of the nozzle enables a consistent gas pressure in the gas chiller.

2. The system of claim 1, wherein the nozzle is positioned in the interior cavity of the pressure vessel.

3. The system of claim 1, wherein the nozzle is positioned in the interior cavity of the pressure vessel and spaced away from the first gas inlet/outlet port.

4. The system of claim 1, wherein the nozzle is positioned outside the interior cavity of the pressure vessel and adjacent the first gas inlet/outlet port.

5. The system of claim 1, wherein the pressure vessel is a compressed natural gas (CNG) vessel.

6. The system of claim 1, wherein an inlet pressure to the nozzle is maintained at a continuous high pressure to increase Joule-Thomson cooling.

7. The system of claim 1, wherein the nozzle maintains a relatively continuous high flow throughout a vessel refilling cycle.

8. The system of claim 1, wherein the pressure vessel is one of a plurality of pressure vessels used for the transport of compressed natural gas (CNG).

9. The system of claim 1, wherein the pressure vessel further comprises a secondary gas outlet port configured to be in releasable fluid communication with the natural gas supply line, whereby a portion of natural gas in the system traverses a cooling cycle loop, cooling the interior cavity and contents of the pressure vessel.

10. The system of claim 9, wherein the secondary gas outlet port is in releasable fluid communication with the natural gas supply line downstream from a compressed natural gas (CNG) buffer storage vessel.

11. The system of claim 9, wherein the cooling cycle loop includes a secondary gas compressor.

12. The system of claim 9, wherein the cooling cycle loop includes a flow control valve in fluid communication with the secondary gas outlet port, whereby a gas recycle rate through the pressure vessel is controlled.

13. The system of claim 9, wherein the cooling cycle loop includes a recirculation compressor in fluid communication with the secondary gas outlet port, whereby a gas recycle rate through the pressure vessel is controlled.

* * * * *